US011283216B2

(12) United States Patent
Zhang

(10) Patent No.: US 11,283,216 B2
(45) Date of Patent: Mar. 22, 2022

(54) FIRST CONNECTOR, SECOND CONNECTOR AND ELECTRICAL CONNECTOR ASSEMBLY

(71) Applicant: Molex, LLC, Lisle, IL (US)

(72) Inventor: Teng-Fei Zhang, Shanghai (CN)

(73) Assignee: Molex, LLC, Lisle, IL (US)

( * ) Notice: Subject to any disclaimer, the term of this patent is extended or adjusted under 35 U.S.C. 154(b) by 3 days.

(21) Appl. No.: 17/016,380

(22) Filed: Sep. 10, 2020

(65) Prior Publication Data

US 2021/0083424 A1 Mar. 18, 2021

(30) Foreign Application Priority Data

Sep. 16, 2019 (CN) ..... 201910870921.6

(51) Int. Cl.
*H01R 13/62* (2006.01)
*H01R 13/504* (2006.01)
*H01R 13/24* (2006.01)

(52) U.S. Cl.
CPC ..... *H01R 13/6205* (2013.01); *H01R 13/504* (2013.01); *H01R 13/2471* (2013.01)

(58) Field of Classification Search
CPC ..... H01R 13/6205; H01R 13/504; H01R 13/2471
See application file for complete search history.

(56) References Cited

U.S. PATENT DOCUMENTS

| | | | | |
|---|---|---|---|---|
| 10,333,249 | B1 * | 6/2019 | Wang | H01R 13/6205 |
| 10,707,610 | B1 * | 7/2020 | Wang | H01R 39/64 |
| 2013/0040469 | A1 | 2/2013 | Hsu | |
| 2016/0056590 | A1 * | 2/2016 | Sugiyama | H01R 13/5202 439/277 |

(Continued)

FOREIGN PATENT DOCUMENTS

| | | | |
|---|---|---|---|
| CN | 1183659 | A | 6/1998 |
| CN | 201266730 | Y | 7/2009 |
| CN | 203631821 | U | 6/2014 |

(Continued)

OTHER PUBLICATIONS

CN First office action received for application No. 201910870921, dated Dec. 3, 2021, pp. 13 (6 pages of English translation and 7 pages of original document).

*Primary Examiner* — Briggitte R. Hammond

(57) ABSTRACT

First and second connectors and an electrical connector assembly are provided. The first connector comprises: an insulating base; a magnetic attraction metal piece which is fixed into the base; a magnet which sheathes the base and is attached to the metal piece; a first terminal which is fixed to the base; and a metal shell which covers the magnet. The second connector comprises: a magnetic attraction metal ring; a fixing base which is integrated with the metal ring; and a second terminal which is correspondingly received in the fixing base. The magnet and the metal ring are correspondingly magnetically attracted, so that the metal shell and the metal ring are attached to each other and the first (Continued)

terminal and the second terminal are electrically connected. The first connector and the second connector can be stably mated with each other and facilitate miniaturization of an electronic device.

10 Claims, 7 Drawing Sheets

(56) References Cited

U.S. PATENT DOCUMENTS

2018/0331468 A1* 11/2018 Little ..... H01R 12/724

FOREIGN PATENT DOCUMENTS

| | | | |
|---|---|---|---|
| CN | 203850544 | U | 9/2014 |
| CN | 206004057 | U | 3/2017 |
| CN | 107734413 | A | 2/2018 |
| CN | 108028497 | A | 5/2018 |
| CN | 207677182 | U | 7/2018 |
| CN | 109075499 | A | 12/2018 |

* cited by examiner

FIRST CONNECTOR, SECOND CONNECTOR AND ELECTRICAL CONNECTOR ASSEMBLY

RELATED APPLICATIONS

This application claims priority to Chinese Patent Application No. 201910870921.6 filed Sep. 16, 2019 which is incorporated by reference in its entirety.

TECHNICAL FIELD

The present disclosure relates to the field of electrical connector, particularly relates to a first connector, a second connector and an electrical connector assembly comprising the first connector and a second connector which realize stable mating and facilitates miniaturization of an electronic device.

BACKGROUND

Chinese utility model patent issuance publication No. CN207677182U discloses a magnet connector, include a magnetic attraction male header and a magnetic attraction female header, the magnetic attraction male header includes a male header outer shell, a male header magnet ring, a male header insulating ring and a male header pin, the four components are coaxially arranged, the male header pin is positioned in an inner cavity of the male header insulating ring, an outer side of the male header insulating ring is surrounded by the male header magnet ring, the male header magnet ring is surrounded by the male header outer shell, a bottom of the male header is provided with a PCB board; the magnetic attraction female header includes a female header outer shell, a female header magnet ring, a female header insulating ring and a female header pin, the four components are coaxially arranged, the female header pin is positioned in an inner cavity of the female header insulating ring, an outer side of the female header insulating ring is surrounded by the female header magnet ring, the female header magnet ring is surrounded by the female header outer shell.

The female header magnet ring of the magnetic attraction female header in such a design might easily detach from the female header insulating ring under the magnetic attraction force, the male header magnet ring of the magnetic attraction male header also might easily upwardly detach from the female header insulating ring, which causes mating between the magnetic attraction female header and the magnetic attraction male header to be not reliable.

SUMMARY

A technical problem to be resolved by the present disclosure is to provide a first connector, a second connector and an electrical connector assembly which realize stable mating and facilitate miniaturization of an electronic device so as to overcome the deficiency in the prior art.

According to one solution of the present disclosure, the present disclosure provides a first connector comprising: an insulating base which comprises a base portion and a positioning post protruding upwardly from the base portion; a magnetic attraction metal piece which is fixed in the base portion and exposed to an upper surface of the base portion; a magnet which sheathes an outer circumference of the positioning post, and a lower end of the magnet is attached to the magnetic attraction metal piece; a first conductive terminal which is fixed to the insulating base, the first conductive terminal comprises a first mating portion which upwardly protrudes from the positioning post and a first tail portion which protrudes downwardly from the base portion; and a metal shell which covers an outer circumference of the magnet and is fixed with the insulating base, an electrical connection leg protruding downwardly from the metal shell, a central hole is provided at a top portion of the metal shell, so as to allow the first mating portion of the first conductive terminal to be exposed.

According to another solution of the present disclosure, the present disclosure further provides a second connector comprising: a magnetic attraction metal ring, a through hole which extends along an up-down direction is defined in a center of the magnetic attraction metal ring, a receiving groove which extends in a radial direction is provided at a bottom surface of the magnetic attraction metal ring; a fixing base which is integrated with the magnetic attraction metal ring, a top surface and a bottom surface of the magnetic attraction metal ring being exposed out of the fixing base, the fixing base comprises a main body and two fixing portions protruding from two sides of the main body, a receiving hole which penetrates in the up-down direction is provided at a middle of the main body, the main body is correspondingly received in the through hole of the magnetic attraction metal ring, the two fixing portions are correspondingly received in the receiving groove of the magnetic attraction metal ring; and a second conductive terminal which is correspondingly received in the receiving hole of the fixing base and comprises a second mating portion exposed upwardly and a second tail portion exposed downwardly.

According to still another solution of the present disclosure, the present disclosure further provides an electrical connector assembly comprising the first connector and the second connector; wherein the magnet of the first connector and the magnetic attraction metal ring of the second connector are correspondingly magnetically attracted, so that the metal shell and the magnetic attraction metal ring are attached to each other, and a first electrical connection between the first mating portion of the first conductive terminal and the second conductive terminal of the second mating portion and a second electrical connection between the metal shell and the magnetic attraction metal ring are maintained.

In comparison with the prior art, the present disclosure at least has the following advantages:

In the first connector, the magnetic attraction metal piece is fixed into the insulating base and the magnetic attraction metal piece is attached to the magnet, the magnet may be attracted firmly and the magnet is prevented from detaching upwardly, in addition, the metal shell covers the outer circumference of the magnet and also can stop the magnet detaching upwardly. The first connector makes the magnet reliably fixed inside, therefore the first connector can provide stable magnetic attraction force and facilitate mating between the first connector and the second connector. At the same time, the magnetic attraction metal piece further attains an effect of gathering together magnetic lines of the magnet, which can increase a mating magnetic force of the first connector so as to facilitate of more stable connection with the second connector.

In the second connector, the fixing base and the magnetic attraction metal ring are integrated with each other. The main body and the fixing portion of the fixing base are respectively formed to the through hole inside the magnetic attraction metal ring and the receiving groove on the bottom surface of the magnetic attraction metal ring, which makes a volume of the fixing base smaller and assist in miniaturization of the electronic device. At the same time, because the receiving groove is provided along the radial direction, the fixing portion can prevent the magnetic attraction metal ring and the fixing base from rotating relative to each other, which makes engagement of the magnetic attraction metal ring and the fixing base more reliable, facilitates realization of stable mating with the first connector.

In the electrical connector assembly, the first conductive terminal and the second conductive terminal are mated with each other to form the first electrical connection, and the metal shell and the magnetic attraction metal ring are attached to each other to form the second electrical connection, so two electrical connections are established between the first connector and the second connector, which facilitate decrease of a size of the connectors and is beneficial to miniaturize the electronic device.

DETAILED DESCRIPTION OF THE PREFERRED EMBODIMENTS

Figure 1:
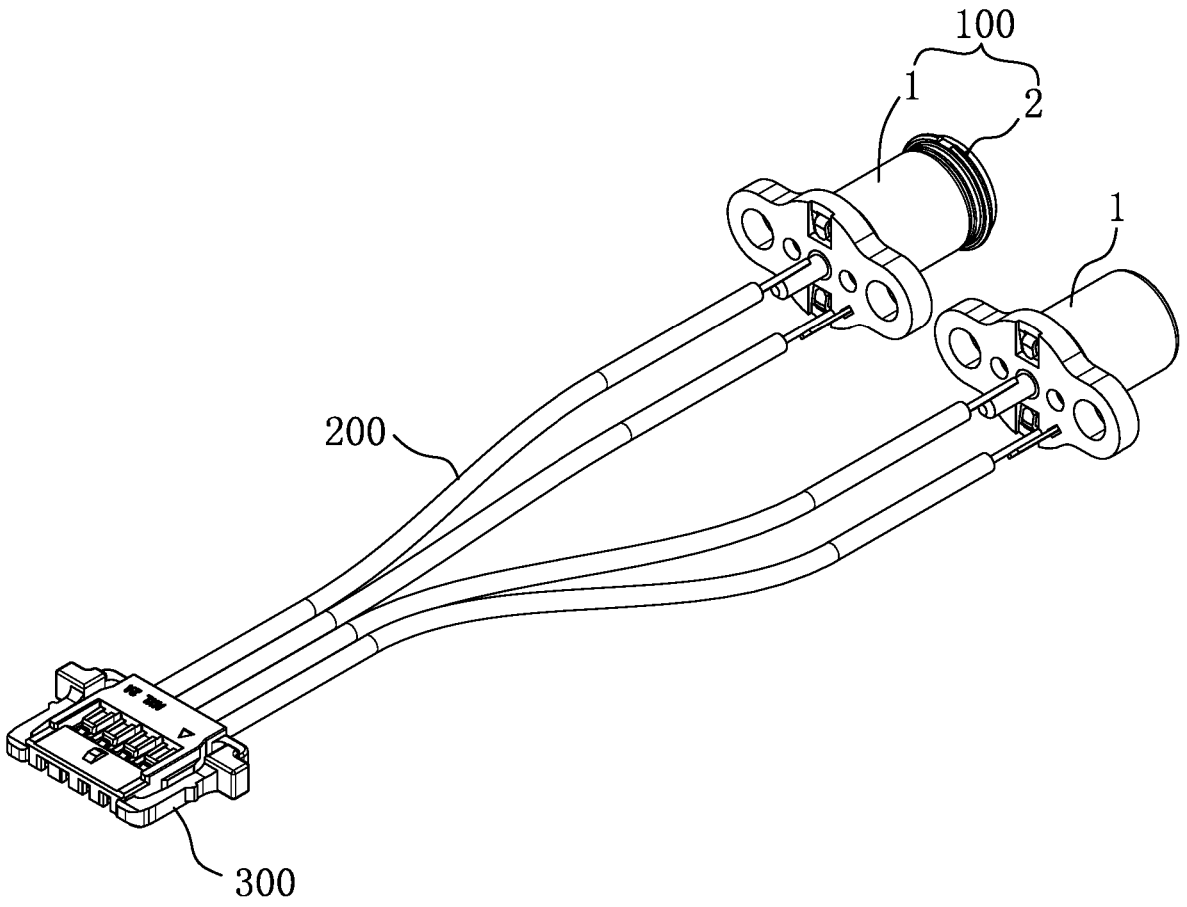
FIG. 1 is a use state view of an electrical connector assembly of a preferred embodiment of the present disclosure.
Figure 2:
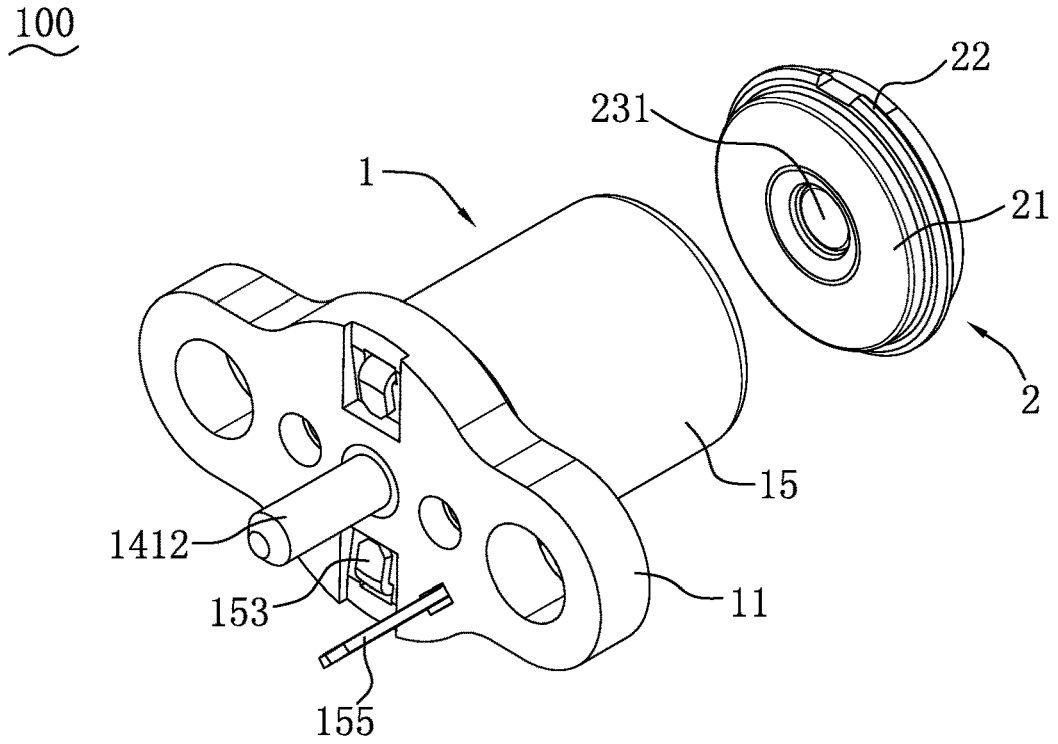
FIG. 2 and FIG. 3 are perspective exploded views of the electrical connector assembly of FIG. 1 viewed from two different angles.
Figure 3:
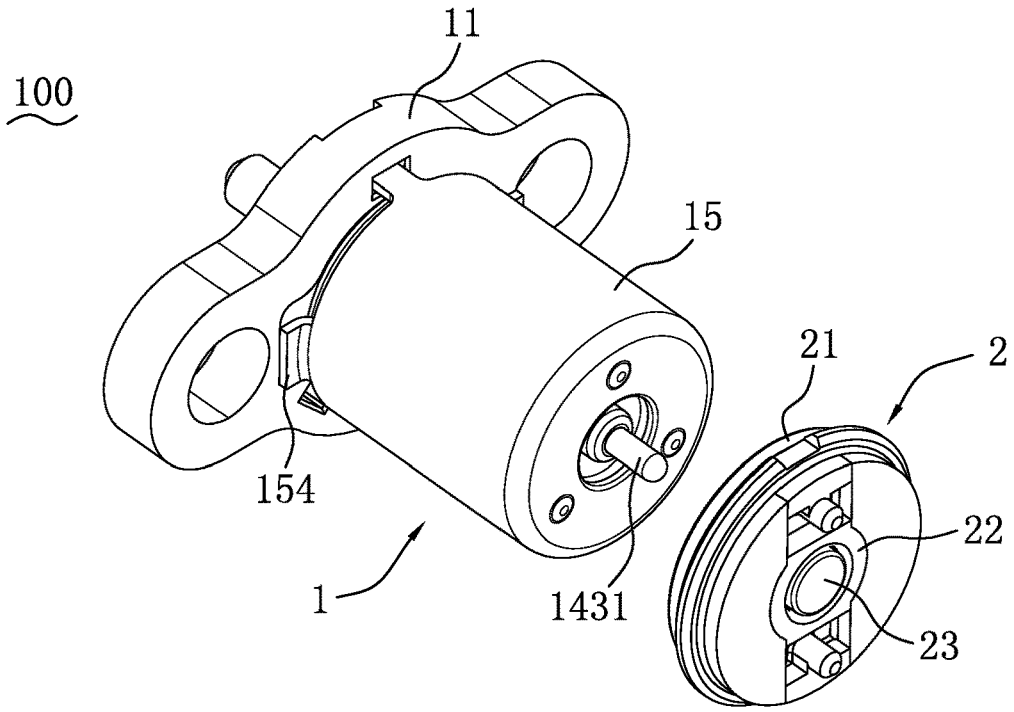
Figure 4:
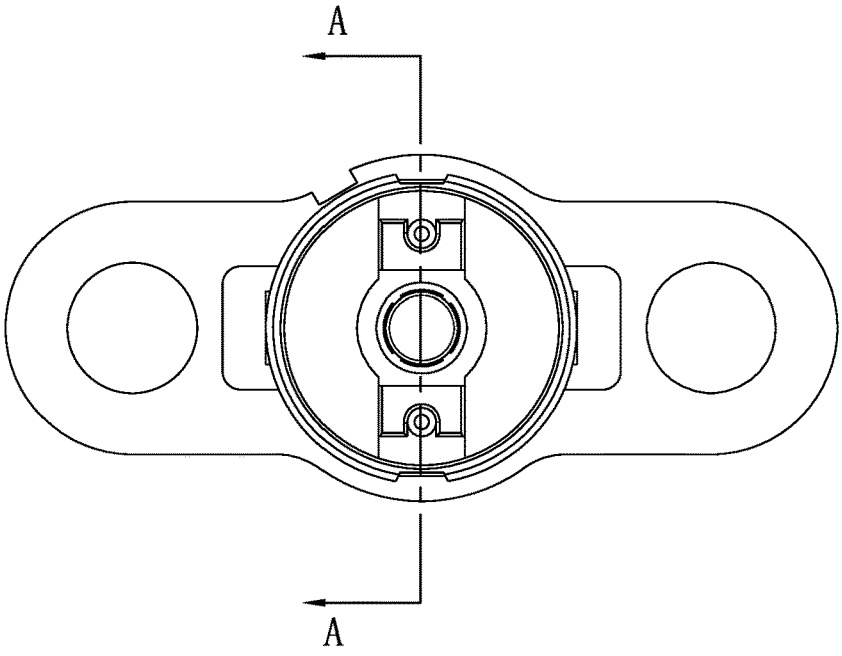
FIG. 4 is a front view of the electrical connector assembly of FIG. 1.

While the present disclosure may be susceptible to embodiments in different forms, there are shown in the figures, and will be described herein in detail, are only specific embodiments, with the understanding that the present disclosure is to be considered as an exemplification of the principles of the present disclosure, and is not intended to limit the present disclosure to that as illustrated.

As such, references to a feature are intended to describe a feature of an embodiment of the present disclosure, not to imply that every embodiment thereof must have the described feature. Furthermore, it should be noted that the description illustrates a number of features. While certain features may be combined together to illustrate potential system designs, those features may also be used in other combinations not expressly described. Thus, the described combinations are not intended to be limiting, unless otherwise noted.

In the embodiments illustrated in the figures, representations of directions such as up, down, left, right, front and rear, used for explaining the structure and movement of the various components of the present disclosure, are not absolute, but relative. These representations are appropriate when the components are in the position shown in the figures. If the description of the position of the components changes, however, these representations are to be changed accordingly.

Hereinafter, preferred embodiments of the present disclosure are further described in detail in combination with the figures of the present disclosure.

Referring to FIG. 1 to FIG. 5, an electrical connector assembly 100 of a preferred embodiment includes a first connector 1 and a second connector 2 which mate with each other. The second connector 2 is preferably used to a device end, particularly adapted to a small-sized electronic device, such as hearing-aid or the like. The first connector 1 is preferably used to be mounted to a cable end, in the present preferred embodiment, the two first connectors 1 are together used to be mounted to a charger, each of the two first connectors 1 is connected to a terminal assembly 300 via two cables 200. Each of the two first connectors 1 may connect one second connector 2, so as to charge the electronic device mounted with the second connector 2.

For sake of convenient description, directions along which an end of the first connector 1 and an end of the second connector 2 are mated with each other are defined as "up", directions away from the "up" ends are "down".

Referring to FIG. 5 to FIG. 8, the first connector 1 includes an insulating base 11, a magnetic attraction metal piece 12, a magnet 13, a first conductive terminal 14 and a metal shell 15.

Figure 6:
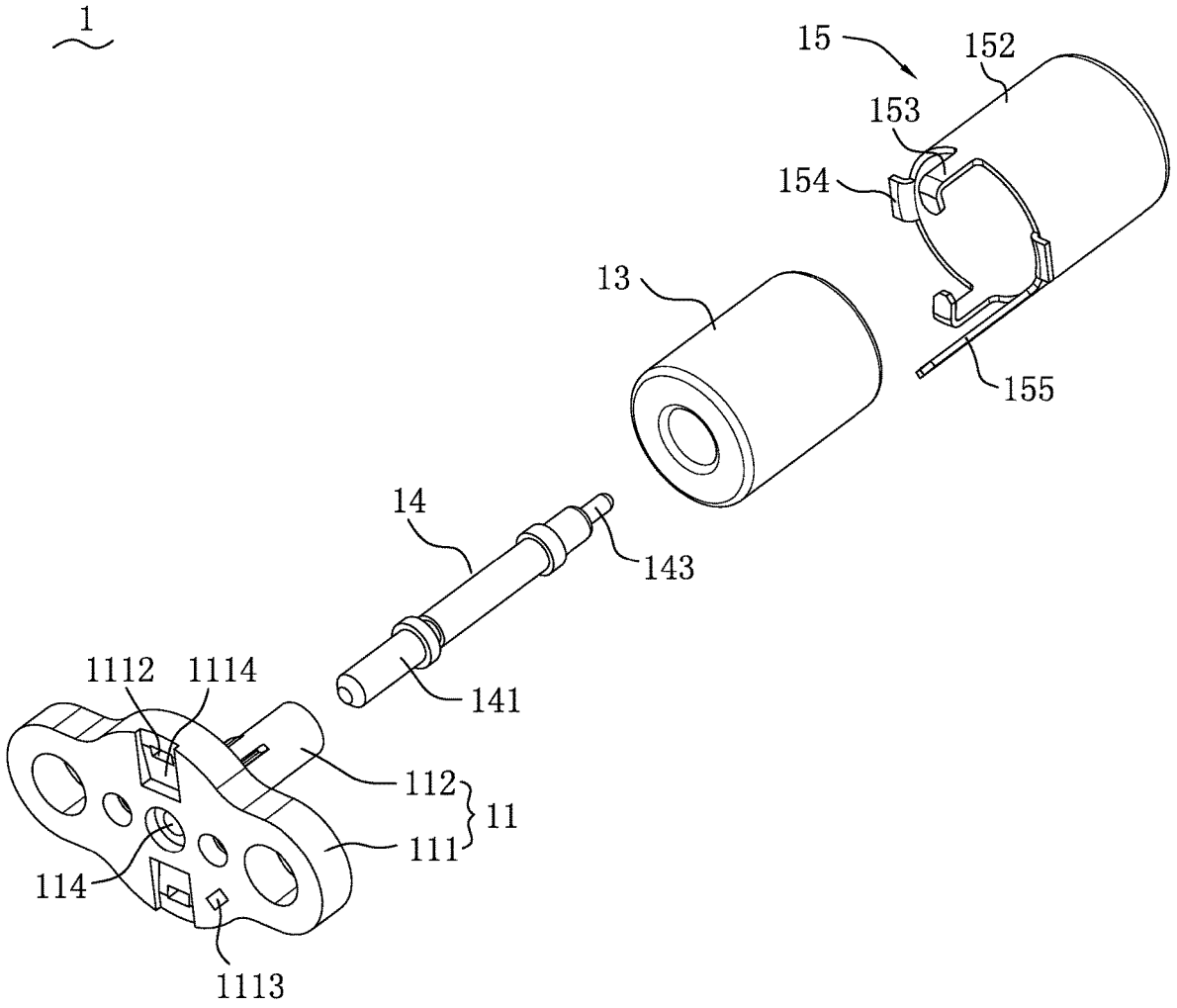
FIG. 6 and FIG. 7 are perspective exploded views of a first connector of FIG. 2 viewed from two different angles.
Figure 7:
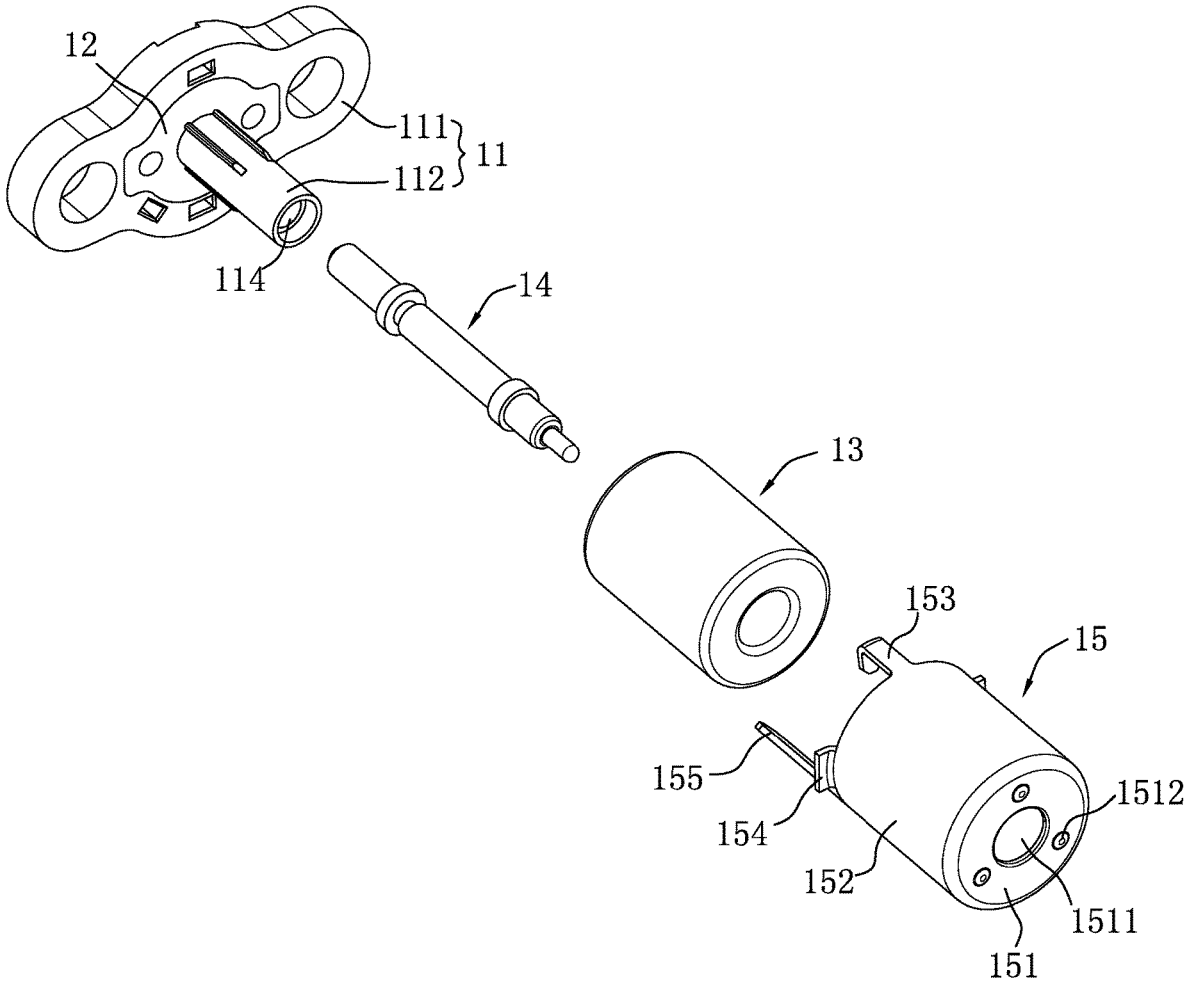

As shown in FIG. 6 and FIG. 7, the insulating base 11 includes a base portion 111 and a positioning post 112 protruding upwardly from a center of the base portion 111. The base portion 111 and the positioning post 112 are integrally formed. The insulating base 11 is formed with a terminal hole 114 therein, the terminal hole 114 upwardly penetrates a top surface of the positioning post 112 and downwardly penetrates a bottom surface of the base portion 111.

Figure 8:
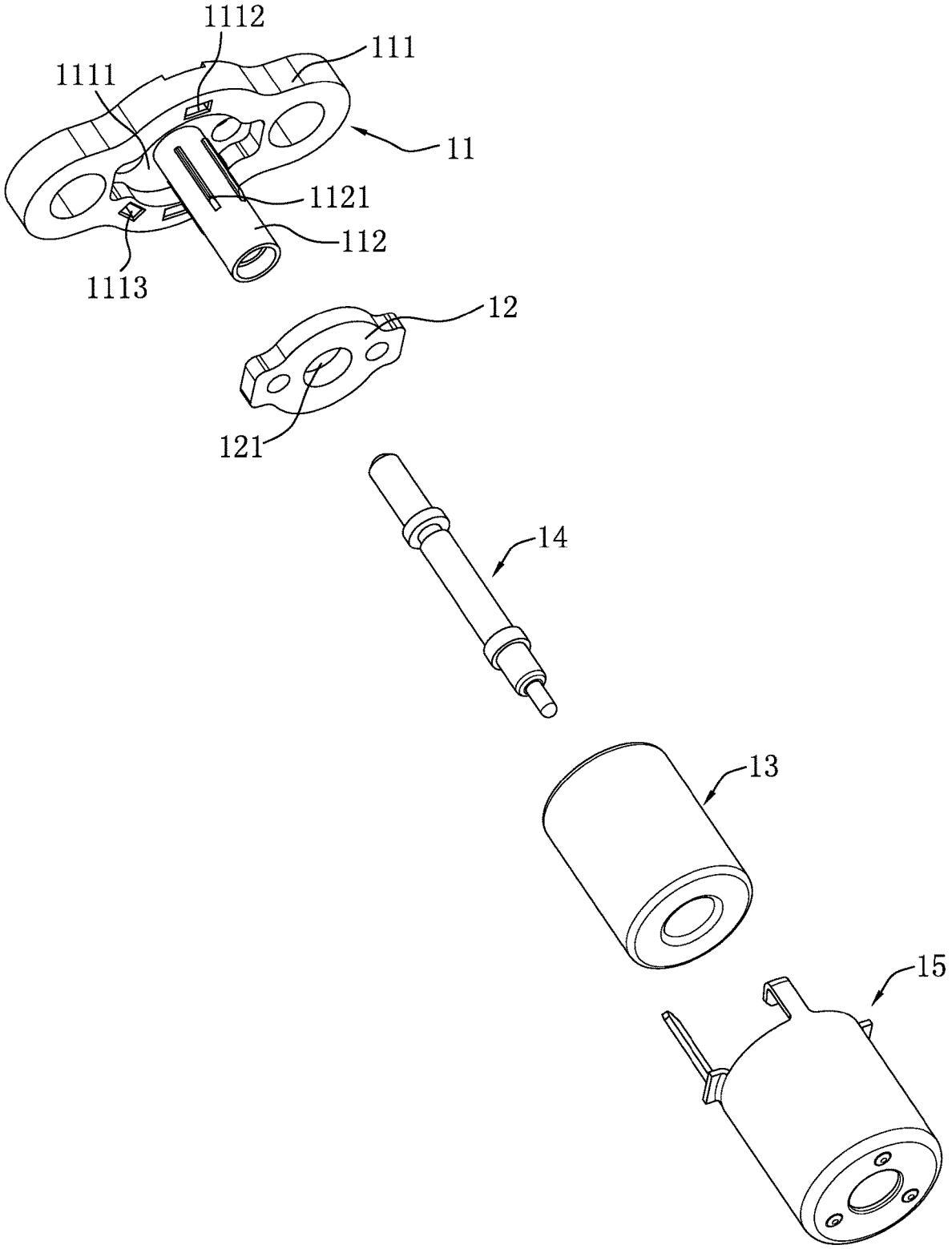
FIG. 8 is a perspective view further exploded on a basis of FIG. 7.

Referring to FIG. 8, an upper surface of the base portion 111 is formed with an insertion groove 1111 surrounding the positioning post 112; the base portion 111 is further provided with two fixing holes 1112 and a penetrating hole 1113 outside the insertion groove 1111, the two fixing holes 1112 are symmetrically distributed at two sides of the insertion groove 1111. As shown in FIG. 6, the two fixing holes 1112 and the penetrating hole 1113 penetrate the base portion 111 in an up-down direction; the bottom surface of the base portion 111 is further provided with two fixing grooves 1114, each fixing groove 1114 is correspondingly communicated with one fixing hole 1112.

The positioning post 112 is in hollow cylinder shaped, a plurality of fixing ribs 1121 preferably protrude outwardly from an outer circumference of the positioning post 112 is, the plurality of fixing ribs 1121 are distributed along a circumferential direction of the positioning post 112 and spaced apart from each other. Each fixing rib 1121 generally extends from a bottom of the positioning post 112 to a position at an about half height of the positioning post 112.

In combination with FIG. 7 and FIG. 8, the magnetic attraction metal piece 12 is preferably integrated with the insulating base 11 together by insert molding, so the magnetic attraction metal piece 12 and the insulating base 11 are engaged with each other tightly and difficult to separate from each other. The magnetic attraction metal piece 12 is fixed in the insertion groove 1111 of the base portion 111 of the insulating base 11, an upper surface of the magnetic attraction metal piece 12 is generally flush with the upper surface of the base portion 111.

A center of the magnetic attraction metal piece 12 has a passageway 121 to allow the positioning post 112 to upwardly extend out from the base portion 111. The fixing rib 1121 of the positioning post 112 abuts the upper surface of the magnetic attraction metal piece 12 to function as pressing the magnetic attraction metal piece 12, further prevent the magnetic attraction metal piece 12 from detaching from the insulating base 11.

In the present preferred embodiment, the magnetic attraction metal piece 12 may be made of iron sheet. But in other embodiments, the magnetic attraction metal piece 12 further may select from other material which may be magnetically attracted, such as nickel iron alloy, silicon steel or the like.

The magnet 13 is in annular shaped and may be ferrite magnet or neodymium iron boron magnet or the like. In combination with FIG. 5 and FIG. 8, the magnet 13 sheathes the outer circumference of the positioning post 112 of the insulating base 11, an inner circumferential wall of the magnet 13 abuts the plurality of fixing ribs 1121 of the positioning post 112, by that the magnet 13 and the positioning post 112 may form interference fit or a glue is applied on the positioning post 112, the magnet 13 is tightly fixed to the positioning post 112.

A lower end of the magnet 13 further preferably is directly attached to the magnetic attraction metal piece 12, the magnetic attraction metal piece 12 attracts firmly magnet 13 under magnetic attraction force function, so as to prevent the magnet 13 from detaching upwardly. At the same time, the magnetic attraction metal piece 12 further may gather together magnetic lines of the magnet 13 so as to strengthen mating magnetic force of the magnet 13.

Figure 5:
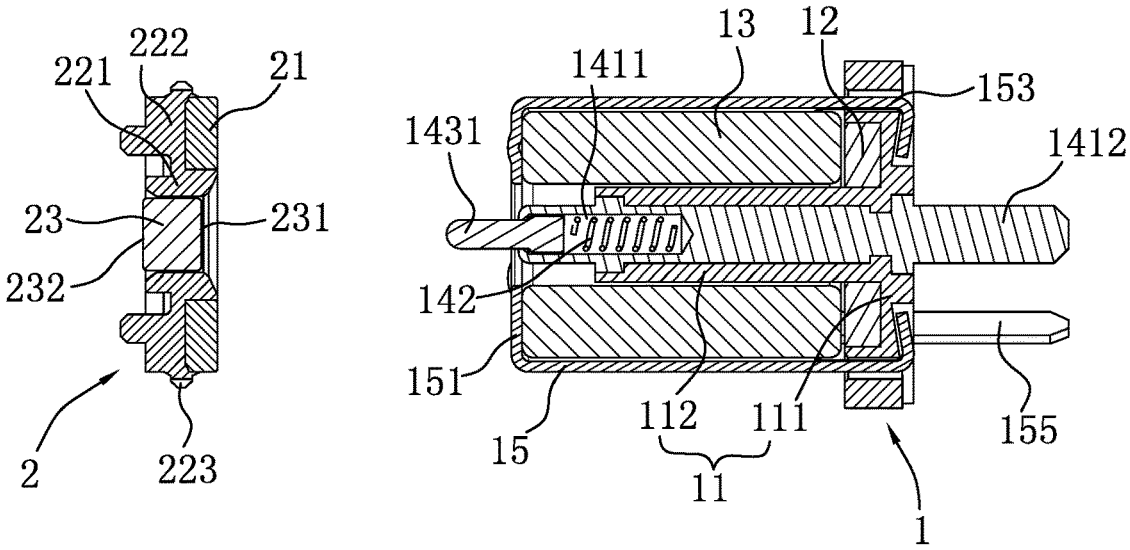
FIG. 5 is a cross sectional view taken along a line A-A of FIG. 4.

Referring to FIG. 5 and FIG. 6, the first conductive terminal 14 preferably is a Pogo Pin (spring pin), and include a pin base 141, a spring 142 which is mounted in the pin base 141 and a pin 143 which can elastically move in the up-down direction in the pin base 141. An upper portion of the pin base 141 is provided with an accommodating groove 1411; the spring 142 is accommodated in the accommodating groove 1411; a lower end of the pin 143 is positioned in the accommodating groove 1411 and abuts the spring 142. By means of elasticity of the spring 142, the pin 143 can move in the up-down direction along the accommodating groove 1411.

The first conductive terminal 14 preferably is integrated with the insulating base 11 together by insert molding. The pin base 141 is fixed to the terminal hole 114 of the insulating base 11, a lower end of the pin base 141 extends out of the base portion 111 of the insulating base 11 downwardly, a part which extends out of the base portion 111 forms a first tail portion 1412 which is used to be electrically connected with the cable 200. An upper end of the pin 143 extends out of the metal shell 15 upwardly and forms a first mating portion 1431 which is used to mate with the second connector 2.

Referring to FIG. 6 and FIG. 7, the metal shell 15 is in hollow cylinder shaped, includes a side wall 152 in hollow cylinder shaped and a top wall 151 connected to an upper end of the side wall 152.

A central hole 1511 is provided at a center of the top wall 151, the central hole 1511 is communicated with an inner cavity which is formed by surrounding of the side wall 152. The top wall 151 is further provided with a plurality of contact protrusions 1512 which protrude upwardly, the plurality of contact protrusions 1512 are distributed around the central hole 1511 along a circumferential direction and spaced apart from each other. Each contact protrusion 1512 may be formed by upwardly stamping the top wall 151 from a lower surface of the top wall 151.

A height of the side wall 152 and a height of the magnet 13 are generally identical, The inner cavity formed by the side wall 152 correspondingly receive the magnet 13. A lower end of the side wall 152 is opened, two fixing legs 153 which face each other and two positioning legs 154 which face each other protrude from the lower end of the side wall 152. The two fixing legs 153 and the two positioning legs 154 are alternately distributed along a circumferential direction of the side wall 152. Each positioning leg 154 bends outwardly from a lower end edge of the side wall 152 and then horizontally extends. An electrical connection leg 155 further downwardly extends out from the lower end of the side wall 152, the electrical connection leg 155 may be used for grounding or transmitting a signal.

Referring to FIG. 5, the metal shell 15 surrounds an outer circumference of the magnet 13, the top wall 151 of the metal shell 15 covers a top surface of the magnet 13 so as to stop the magnet 13 detaching upwardly from and prevent the magnet 13 from being contaminated. The central hole 1511 of the top wall 151 may allow the first mating portion 1431 of the first conductive terminal 14 to extend out upwardly. The metal shell 15 preferably uses copper material, which not only does not interrupt magnetic lines of the magnet 13 but also is beneficial for conductivity, the metal shell 15 functions to protect the magnet 13 and at the same time does not lower the magnetic force.

In combination with FIG. 2, FIG. 3, FIG. 5 and FIG. 6, the two fixing legs 153 of the metal shell 15 each pass through one fixing hole 1112 of the insulating base 11, a tail end of each fixing leg 153 passes through the fixing hole 1112 and then bends to be fixed in the fixing groove 1114. The two positioning legs 154 of the metal shell 15 respectively abut the upper surface of the magnetic attraction metal piece 12. The metal shell 15 is fixed to the insulating base 11 by the two fixing legs 153 and the two positioning legs 154. The electrical connection leg 155 of the metal shell 15 downwardly extends out of the penetrating hole 1113 of the insulating base 11 to be electrically connected with the cable 200.

An assembling process of the first connector 1 generally is: forming the insulating base 11 around the magnetic attraction metal piece 12 and the first conductive terminal 14 by insert molding, then making the magnet 13 sheathe the outer circumference of the positioning post 112 of the insulating base 11, finally making the metal shell 15 sheathe the outer circumference of the magnet 13, bending the fixing legs 153 of the metal shell 15 after the fixing legs 153 of the metal shell 15 passes through the fixing holes 1112 of the insulating base 11 respectively so as to fix the metal shell 15 to the insulating base 11. The first tail portion 1412 of the first conductive terminal 14 and the electrical connection leg 155 of the metal shell 15 downwardly extend out of the insulating base 1 and each allow one cable 200 to be electrically connected therewith.

In the first connector 1, the magnetic attraction metal piece 12 is fixed into the insulating base 11 and the magnetic attraction metal piece 12 is attached to the magnet 13, the magnet 13 may be attracted firmly and the magnet 13 is prevented from detaching upwardly, in addition, the metal shell 15 covers the outer circumference of the magnet 13 and also can stop the magnet 13 detaching upwardly. The first connector 1 makes the magnet 13 reliably fixed inside, therefore the first connector 1 can provide stable magnetic attraction force and facilitate mating between the first connector 1 and the second connector 2. At the same time, the magnetic attraction metal piece 12 further attains an effect of gathering together magnetic lines of the magnet 13, which can increase a mating magnetic force of the first connector 1 so as to facilitate of more stable connection with the second connector 2.

Figure 9:
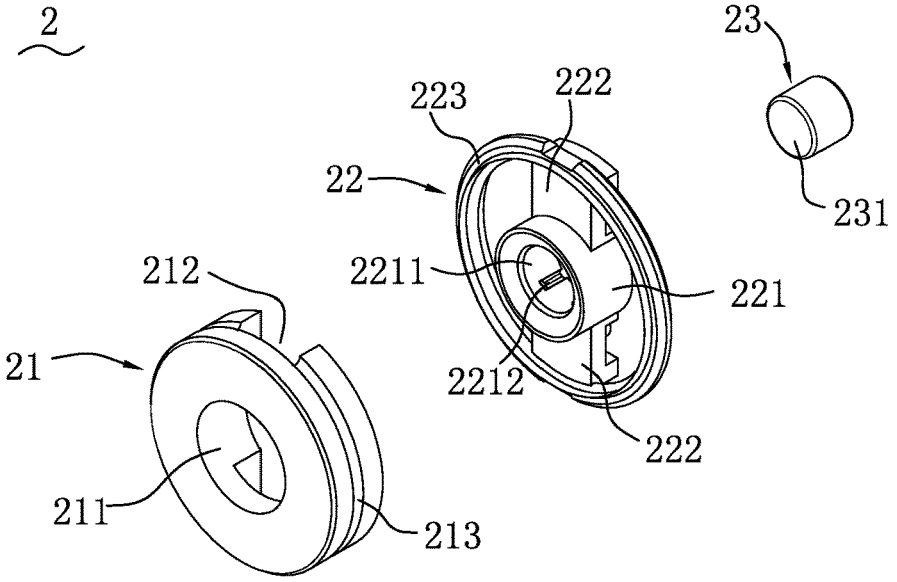
FIG. 9 and FIG. 10 are perspective exploded views of a second connector of FIG. 2 viewed from two different angles.
Figure 10:
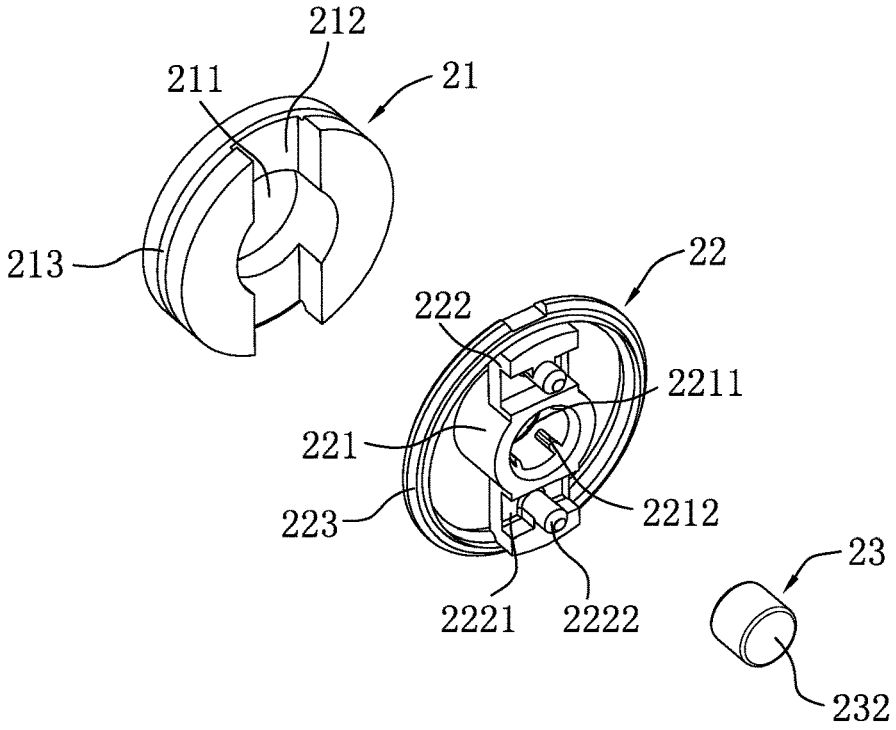

Referring to FIG. 5, FIG. 9 and FIG. 10, the second connector 2 includes a magnetic attraction metal ring 21, a fixing base 22 and a second conductive terminal 23.

The magnetic attraction metal ring 21 is in circular annular shaped, a through hole 211 which extends in the up-down direction is defined in a center of the magnetic attraction metal ring 21. A receiving groove 212 which extends radially and preferably penetrates two side edges of the magnetic attraction metal ring 21 is provided at a bottom surface of the magnetic attraction metal ring 21, a middle of the receiving groove 212 is communicated with the through hole 211. A concave groove 213 is provided at an outer circumference of the magnetic attraction metal ring 21, the concave groove 213 is communicated with a groove bottom of the receiving groove 212. In the present preferred embodiment, the magnetic attraction metal ring 21 is made of stainless steel which can be magnetically attracted.

The fixing base 22 is made of plastic material and integrated with the magnetic attraction metal ring 21, the fixing base 22 and the magnetic attraction metal ring 21 are preferably integrated with each other by insert molding or assembling process. A top surface and a bottom surface of the magnetic attraction metal ring 21 are exposed out of the fixing base 22.

The fixing base 22 includes a main body 221 and two fixing portions 222 protruding from two sides of the main body 221, and preferably, an annular portion 223 is further connected to outer side edges of the two fixing portions 222.

The main body 221 is in hollow circular cylinder shaped and a receiving hole 2211 which penetrates in the up-down direction is provided in the main body 221, an inner wall of the receiving hole 2211 is further provided with a plurality of rib strips 2212 which protrude.

The two fixing portions 222 extend out away from each other from two outer side surfaces of the main body 221 along a diameter direction of the main body 221. A bottom surface of each fixing portion 222 is provided with a recessed groove 2221, a protruding post 2222 protruding downwardly is further provided in the recessed groove 2221, the recessed groove 2221 and the protruding post 2222 may facilitate positioning of the second connector 2 when the second connector 2 is mounted to the electronic device (not shown). The annular portion 223 encircles the main body 221 and the two fixing portions 222 therein, the annular portion 223 is connected with outer ends of the two fixing portions 222.

The main body 221 of the fixing base 22 is correspondingly received in the through hole 211 of the magnetic attraction metal ring 21, a top surface of the main body 221 and the top surface of the magnetic attraction metal ring 21 are generally flush with each other. The two fixing portions 222 of the fixing base 22 are correspondingly received in the receiving groove 212 of the magnetic attraction metal ring 21. The annular portion 223 of the fixing base 22 is correspondingly fixed in the concave groove 213 of the magnetic attraction metal ring 21.

The second conductive terminal 23 is a metal post, in circular cylinder shaped and is received in the receiving hole 2211 of the main body 221, an outer circumference of the second conductive terminal 23 and the rib strips 2212 in the receiving hole 2211 abut each other and are fixed together. A top surface of the second conductive terminal 23 is exposed to the top surface of the main body 221 to form a second mating portion 231 which allows the first conductive terminal 14 of the first connector 1 to mate therewith. In the present preferred embodiment, the second conductive terminal 23 preferably downwardly sunk into the receiving hole 2211, the top surface of the second conductive terminal 23 is lower than the top surface of the main body 221, which facilitate alignment and mating with the first conductive terminal 14. A lower end of the second conductive terminal 23 slightly extend out of a bottom surface of the main body 221 to form a second tail portion 232 which is used to be connected with a circuit board (not shown) of the electronic device.

In the second connector 2, the magnetic attraction metal ring 21 and the fixing base 22 are preferably integrated with each other by insert molding, the magnetic attraction metal ring 21 and the fixing base 22 are fixed tightly to avoid the magnetic attraction metal ring 21 separating from the fixing base 22. The main body 221 and the fixing portion 222 of the fixing base 22 are respectively formed to the through hole 211 inside the magnetic attraction metal ring 21 and the receiving groove 212 on the bottom surface of the magnetic attraction metal ring 21, which makes a volume of the fixing base 22 smaller and assist in miniaturization of the electronic device. At the same time, because the receiving groove 212 is provided along the radial direction, the fixing portion 222 can prevent the magnetic attraction metal ring 21 and the fixing base 22 from rotating relative to each other, which makes engagement of the magnetic attraction metal ring 21 and the fixing base 22 more reliable, facilitates realization of stable mating with the first connector 1.

Furthermore, the annular portion 223 of the fixing base 22 further encircles the magnetic attraction metal ring 21 therein, which increases a holding force with respect to the magnetic attraction metal ring 21, and further improves structure reliability of the second connector 2.

In combination with FIG. 1 to FIG. 3, FIG. 5, when the second connector 2 and the first connector 1 are mate with each other, the magnetic attraction metal ring 21 of the second connector 2 and the metal shell 15 of the first connector 1 face each other, the magnetic attraction force between the magnet 13 of the first connector 1 and the magnetic attraction metal ring 21 provides a normal force for a stable connection therebetween to make the magnetic attraction metal ring 21 and the metal shell 15 reliably attached together, at the same time, the first mating portion 1431 of the first conductive terminal 14 also is tightly mated with the second mating portion 231 of the second conductive terminal 23 together. By that the metal shell 15 and the magnetic attraction metal ring 21 are attached to each other and the first mating portion 1431 and the second mating portion 231 are mated with each other, a first electrical connection and a second electrical connection between the first connector 1 and the second connector 2 are established, here the metal shell 15 of the first connector 1 preferably acts as a grounding terminal for a power supply, the first conductive terminal 14 preferably acts as an input terminal for the power supply to transmit current toward the second connector 2, so as to charge the electronic device mounted with the second connector 2.

In the electrical connector assembly 100, the first conductive terminal 14 and the second conductive terminal 23 are mated with each other to form the first electrical connection, and the metal shell 15 and the magnetic attraction metal ring 21 are attached to each other to form the second electrical connection, so two electrical connections are established between the first connector 1 and the second connector 2, which facilitate decrease of a size of the connectors and is beneficial to miniaturize the electronic device.

The above described contents are only the preferred embodiments of the present disclosure, which cannot limit the implementing solutions of the present disclosure, those skilled in the art may conveniently make corresponding variation or modification based on the main concept and spirit of the present disclosure, therefore the extent of protection of the present disclosure shall be determined by terms of the Claims.

What is claimed is:

1. A first connector, comprising:

an insulating base which comprises a base portion and a positioning post protruding upwardly from the base portion;

a magnetic attraction metal piece which is fixed in the base portion and exposed to an upper surface of the base portion;

a magnet which sheathes an outer circumference of the positioning post, and a lower end of the magnet being attached to the magnetic attraction metal piece;

a first conductive terminal which is fixed to the insulating base, the first conductive terminal comprising a first mating portion which upwardly protrudes from the positioning post and a first tail portion which protrudes downwardly from the base portion; and a metal shell which covers the outer circumference of the magnet and is fixed with the insulating base, an electrical connection leg protruding downwardly from the metal shell, a central hole being provided at a top portion of the metal shell, so as to allow the first mating portion of the first conductive terminal to be exposed.

2. The first connector according to claim 1, wherein a plurality of fixing ribs protrude outwardly from the positioning post, the plurality of fixing ribs tightly abut an inner circumferential wall of the magnet.

3. The first connector according to claim 2, wherein the plurality of fixing ribs are distributed along a circumferential direction of the positioning post and abut an upper surface of the magnetic attraction metal piece.

4. The first connector according to claim 1, wherein the first conductive terminal is a Pogo Pin which comprises a pin base, a spring mounted in the pin base and a pin which can elastically moves-in an up-down direction in the pin base; wherein the pin base is fixed to the insulating base, the pin acts as the first mating portion and upwardly extends out of the top portion of the metal shell.

5. The first connector according to claim 1, wherein the metal shell is in hollow cylinder shaped, a plurality of fixing legs protrude from a lower end of the metal shell, the fixing legs are fixed to the base portion.

6. A second connector comprising:

a magnetic attraction metal ring, a through hole which extends along an up-down direction is defined in a center of the magnetic attraction metal ring, a receiving groove which extends in a radial direction is provided at a bottom surface of the magnetic attraction metal ring;

a fixing base which is integrated with the magnetic attraction metal ring, a top surface and a bottom surface of the magnetic attraction metal ring being exposed out of the fixing base, the fixing base comprising a main body and two fixing portions protruding from two sides of the main body, a receiving hole which penetrates in the up-down direction is provided at a middle of the main body, the main body being correspondingly received in the through hole of the magnetic attraction metal ring, the two fixing portions being correspondingly received in the receiving groove of the magnetic attraction metal ring; and a second conductive terminal which is correspondingly received in the receiving hole of the fixing base and comprises a second mating portion exposed upwardly and a second tail portion exposed downwardly.

7. The second connector according to claim 6, wherein the magnetic attraction metal ring is integrated with the fixing base by insert molding.

8. The second connector according to claim 6, wherein a concave groove is provided at an outer circumference of the magnetic attraction metal ring; an annular portion which is formed in the fixing base corresponds to the concave groove, the annular portion is connected with the two fixing portions.

9. The second connector according to claim 6, wherein the second conductive terminal is a metal post, a top surface of the second conductive terminal is lower than a top surface of the main body.

10. An electrical connector assembly comprising:

a first connector having an insulating base, a magnetic attraction metal piece, a magnet, a first conductive terminal, and a metal shell, the insulating base has a base portion and a positioning post protruding upwardly from the base portion, the magnetic attraction metal piece is fixed in the base portion and exposed to an upper surface of the base portion, the magnet sheathes an outer circumference of the positioning post, and a lower end of the magnet is attached to the magnetic attraction metal piece, the first conductive terminal is is fixed to the insulating base, the first conductive terminal comprising a first mating portion which upwardly protrudes from the positioning post and a first tail portion which protrudes downwardly from the base portion, the metal shell covers the outer circumference of the magnet and is fixed with the insulating base, an electrical connection leg protruding downwardly from the metal shell, a central hole being provided at a top portion of the metal shell, so as to allow the first mating portion of the first conductive terminal to be exposed; and a second connector having a magnetic attraction metal ring, a fixing base, and a second conductive terminal, the magnetic attraction metal ring having a through hole which extends along an up-down direction and is defined in a center of the magnetic attraction metal ring, a receiving groove which extends in a radial direction is provided at a bottom surface of the magnetic attraction metal ring, the fixing base is integrated with the magnetic attraction metal ring, a top surface and a bottom surface of the magnetic attraction metal ring being exposed out of the fixing base, the fixing base comprising a main body and two fixing portions protruding from two sides of the main body, a receiving hole which penetrates in the up-down direction is provided at a middle of the main body, the main body being correspondingly received in the through hole of the magnetic attraction metal ring, the two fixing portions being correspondingly received in the receiving groove of the magnetic attraction metal ring, the second conductive terminal is correspondingly received in the receiving hole of the fixing base and comprises a second mating portion exposed upwardly and a second tail portion exposed downwardly, wherein the magnet of the first connector and the magnetic attraction metal ring of the second connector are correspondingly magnetically attracted, so that the metal shell and the magnetic attraction metal ring are attached to each other, and a first electrical connection between the first mating portion of the first conductive terminal and the second conductive terminal of the second mating portion and a second electrical connection between the metal shell and the magnetic attraction metal ring are maintained.

* * * * *